US006867398B2

(12) United States Patent
Lee

(10) Patent No.: US 6,867,398 B2
(45) Date of Patent: Mar. 15, 2005

(54) MICROWAVE OVEN WITH TOASTER

(75) Inventor: Jong Woog Lee, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/669,364

(22) Filed: Sep. 25, 2003

(65) Prior Publication Data

US 2004/0056024 A1 Mar. 25, 2004

(30) Foreign Application Priority Data

Sep. 25, 2002 (KR) ..... 10-2002-0058186

(51) Int. Cl.[7] ..... H05B 6/80

(52) U.S. Cl. ..... 219/680; 219/685; 219/722; 219/739; 219/756; 99/451

(58) Field of Search ..... 219/685, 680, 219/722–724, 756, 739, 762, 763, 386, 413, 521; 99/385, 391, 392, 393, 399, 400, 402, 451, DIG. 14

(56) References Cited

U.S. PATENT DOCUMENTS 3,086,511 A * 4/1963 Loch ..... 126/335
4,982,063 A * 1/1991 Tsunekawa et al. ..... 219/723
2002/0070212 A1 * 6/2002 Choi et al. ..... 219/680
2003/0042252 A1 * 3/2003 Back et al. ..... 219/679

FOREIGN PATENT DOCUMENTS

JP 4-39524 * 2/1992 ..... 219/722

* cited by examiner

*Primary Examiner*—Philip H. Leung
(74) *Attorney, Agent, or Firm*—Mckenna Long & Aldridge, LLP

(57) ABSTRACT

Microwave oven with a toaster comprising a main case forming an outer shape, a cavity in the main case for cooking food therein with a microwave, an electronic chamber in one side part of the main case having different electronic components for providing the microwave to an inside of the cavity, and a toaster comprising a toaster case in front of the electronic chamber having slits in opposite sides respectively, a tray assembly mounted on the slits of the toaster case for introducing/taking out pieces of bread into/out of the toaster, a heater assembly in the toaster case for heating the pieces of bread, a toaster door on the toaster case, a door lock for holding the door, and a power source device for supplying power to the heater assembly, thereby providing a cooking function with a microwave, and toasting function with a toaster.

20 Claims, 6 Drawing Sheets

MICROWAVE OVEN WITH TOASTER

This application claims the benefit of the Korean Application No. P2002-58186 filed on Sep. 25, 2002, which is hereby incorporated by reference.

BACKGROUND OF THE INVENTION

1. Field of the Invention

The present invention relates to microwave ovens, and more particularly, to a microwave oven with a toaster which has a cooking function together with a toasting function.

2. Background of the Related Art

In general, the microwave ovens are cooking appliances for cooking or thawing food with a microwave. The microwave ovens have been developed to meet demand for cooking food faster and more conveniently under the pressure of busy daily life.

A related art microwave oven will be described with reference to the attached FIG. 1. FIG. 1 illustrates a disassembled perspective view of a related art microwave oven.

Referring to FIG. 1, the related art microwave oven is provided with a main case 10 forming an outer shape, a cavity 20 for receiving food, and an electronic chamber 300 in one side part of the main case having different electronic components for providing the microwave to an inside of the cavity.

The main case has in general a front case 11, an outer case 12, and an outer frame 13 for supporting the microwave to be in shape. There is a cavity door (not shown) on an opening in the front case for opening/closing the cavity.

In the meantime, the electronic chamber is provided with a magnetron 31 for generating a microwave required for cooking of food, a transformer 32 for providing a high voltage to the magnetron, and fan 33 for cooling various electronic components in the main case.

The related art microwave oven, an appliance for applying the microwave to a cooking object, is favorable for cooking general food, but not suitable for toasting bread.

To cope with the problem, there have been steady requirements for development of a microwave oven having a toasting function together with a cooking function by using a microwave.

SUMMARY OF THE INVENTION

Accordingly, the present invention is directed to a microwave oven with a toaster that substantially obviates one or more of the problems due to limitations and disadvantages of the related art.

An object of the present invention is to provide a microwave oven with a toaster, which has a cooking function together with a toasting function.

Another object of the present invention is to provide a microwave oven with a toaster, which has a door lock that permits to carry out a toasting operation only when a toaster door on the microwave oven is closed, perfectly.

Additional features and advantages of the invention will be set forth in the description which follows, and in part will be apparent to those having ordinary skill in the art upon examination of the following or may be learned from practice of the invention. The objectives and other advantages of the invention will be realized and attained by the structure particularly pointed out in the written description and claims hereof as well as the appended drawings.

To achieve these objects and other advantages and in accordance with the purpose of the present invention, as embodied and broadly described herein, the microwave oven with a toaster comprises a main case forming an outer shape, a cavity in the main case for cooking food therein with a microwave, an electronic chamber in one side part of the main case having different electronic components for providing the microwave to an inside of the cavity, and a toaster comprising a toaster case in front of the electronic chamber having slits in opposite sides respectively, a tray assembly mounted on the slits of the toaster case for introducing/taking out pieces of bread into/out of the toaster, a heater assembly in the toaster case for heating the pieces of bread, a toaster door on the toaster case, a door lock for holding the door, and a power source device for supplying power to the heater assembly.

The toaster further comprises a front plate mounted to a front of the toaster case having openings for introducing pieces of bread therethrough, and a front panel having a rectangular body with a central opening mounted to a front of the front plate to form an outer shape of the toaster, and the toaster door coupled thereto.

The door lock for holding the door comprises a plate spring mounted on the front panel for holding the toaster door to keep a closed state once the toaster door is closed.

The plate spring has a channel section, and comprises a locking part at a lower side thereof for holding the toaster door.

The locking part comprises a projection of a lower part of the plate spring toward the opening in the front panel, and the toaster door comprises a catch recess in conformity with the projection of the plate spring.

The power source device comprises a switch to be pressed when the toaster door is closed.

The toaster further comprises lever at an opening side of the front panel having one side opposite to the power source device and the other side opposite to the toaster door, for transmitting a pushing force of the toaster door to the switch. The lever comprises a part opposite to the toaster door projected to the opening side.

The toaster door further comprises a push projection opposite to the projection on the lever. The lever rotates and pushes the switch of the power source device as the pushing projection of the toaster door pushes the lever when the toaster door is closed.

In more detail, the switch comprises a body of an angle section, and a shaft at a bent part for rotatably mounting the body.

The switch is pushed with the lever fully, to supply power to the heater assembly, only when the toaster door is closed completely.

In the meantime, the front panel further comprises a heat insulating film for preventing transmission of heat from the heat assembly to the toaster door and the front panel itself.

Thus, the microwave oven with a toaster of the present invention eliminates the inconvenience of providing a toaster in addition to a microwave oven, prevents waste of power, occurrence of accident caused of negligence of safety, and thermal deformation of the front panel.

It is to be understood that both the foregoing description and the following detailed description of the present invention are exemplary and explanatory and are intended to provide further explanation of the invention claimed.

BRIEF DESCRIPTION OF THE DRAWINGS

The accompanying drawings, which are comprised to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiments of the present invention, examples of which are illustrated in the accompanying drawings. In describing the embodiments, same parts will be given the same names and reference symbols, and repetitive description of which will be omitted.

In general, the microwave ovens are cooking appliances for cooking or thawing food with a microwave. The microwave ovens have been developed to meet demand for cooking food faster and more conveniently under the pressure of busy daily life.

Figure 1:
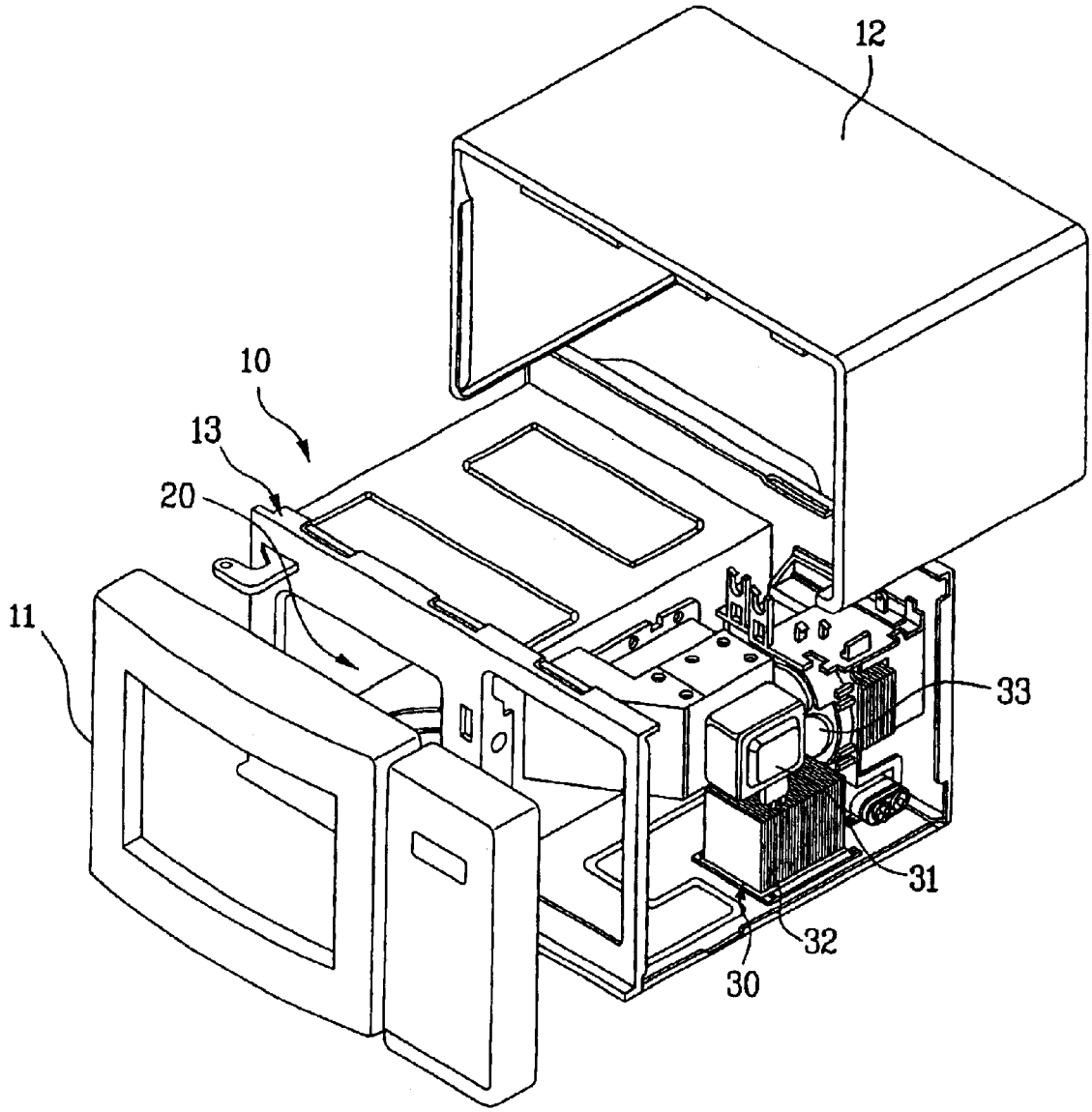
FIG. 1 Related Art
FIG. 1 illustrates a disassembled perspective view of a related art microwave oven.
Figure 2:
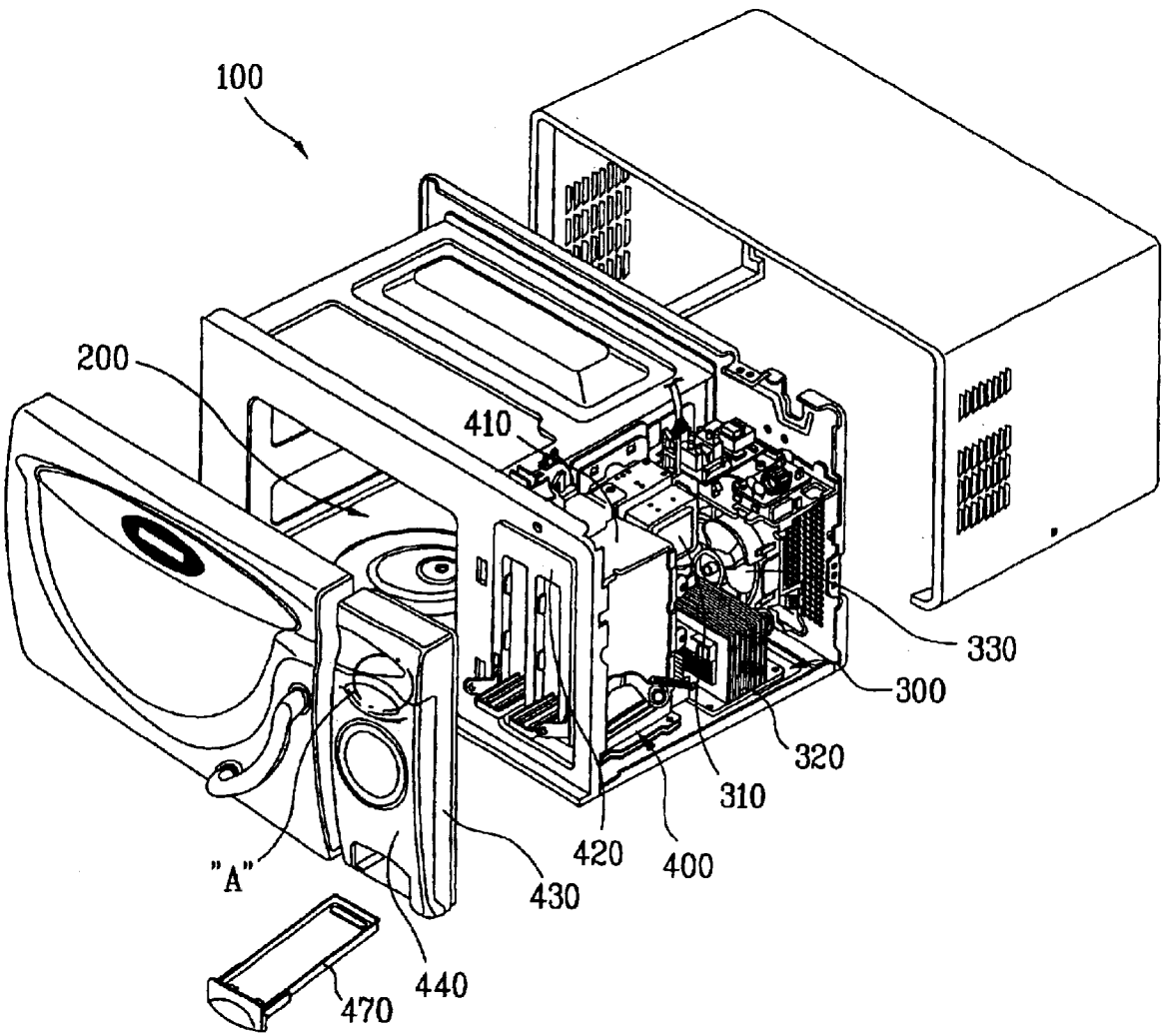
FIG. 2 illustrates a disassembled perspective view of a microwave oven with a toaster in accordance with a preferred embodiment of the present invention.

What is developed to cope with the requirements is the microwave oven with a toaster. A whole system of the microwave oven with a toaster of the present invention having a toasting function added to the related art microwave oven will be described with reference to FIGS. 2 and 3. FIG. 2 illustrates a disassembled perspective view of a microwave oven with a toaster in accordance with a preferred embodiment of the present invention.

Referring to FIG. 2, the microwave oven comprises a main case 100 forming an outer shape, a cavity 200 in the main case for cooking food therein with the microwave, an electronic chamber 300 in one side part of the main case having different electronic components for providing the microwave to an inside of the cavity, and a toaster 400.

As described before, the cavity, a space for receiving and cooking food therein, the same function and system with the related art, of which description will be omitted. However, a size of the space may differ depending on applications.

The electronic chamber has a magnetron 310 for generating a microwave required for cooking of food, a transformer 320 for providing a high voltage to the magnetron, and fan 330 for cooling heat generated in cooking food.

It is preferable that the toaster 400 is mounted in front of the electronic chamber 300.

Because the microwave oven with a toaster of the present invention has various electronic components and the toaster mounted within a limited main case, heat more than the related art microwave oven is generated. Therefore, it is preferable that a cooling efficiency is improved by methods, such as increasing a rotation speed of the fan, or the like.

Figure 3:
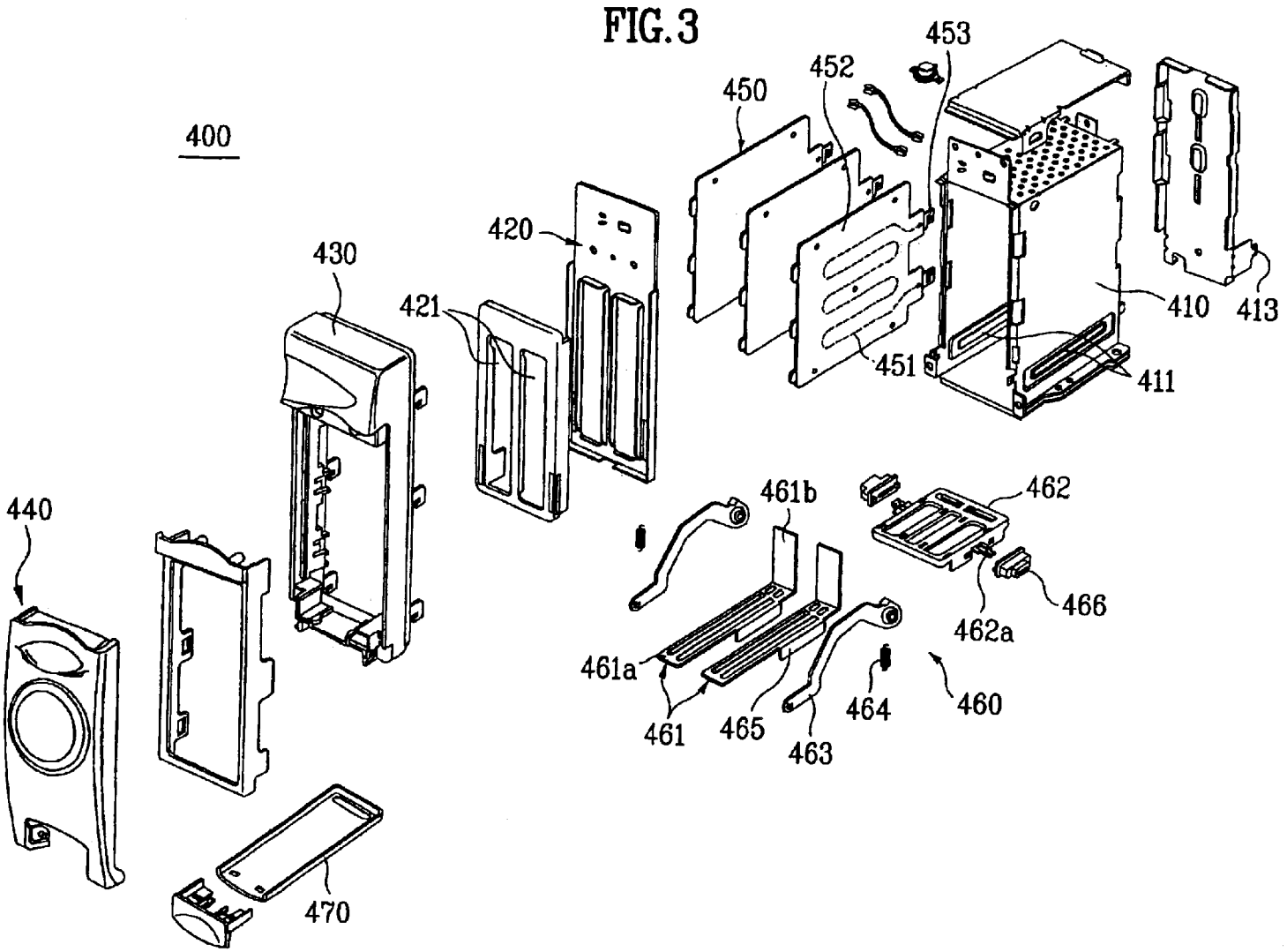
FIG. 3 illustrates a disassembled perspective view of a toaster part in a microwave oven with a toaster in accordance with a preferred embodiment of the present invention.
Figure 4:
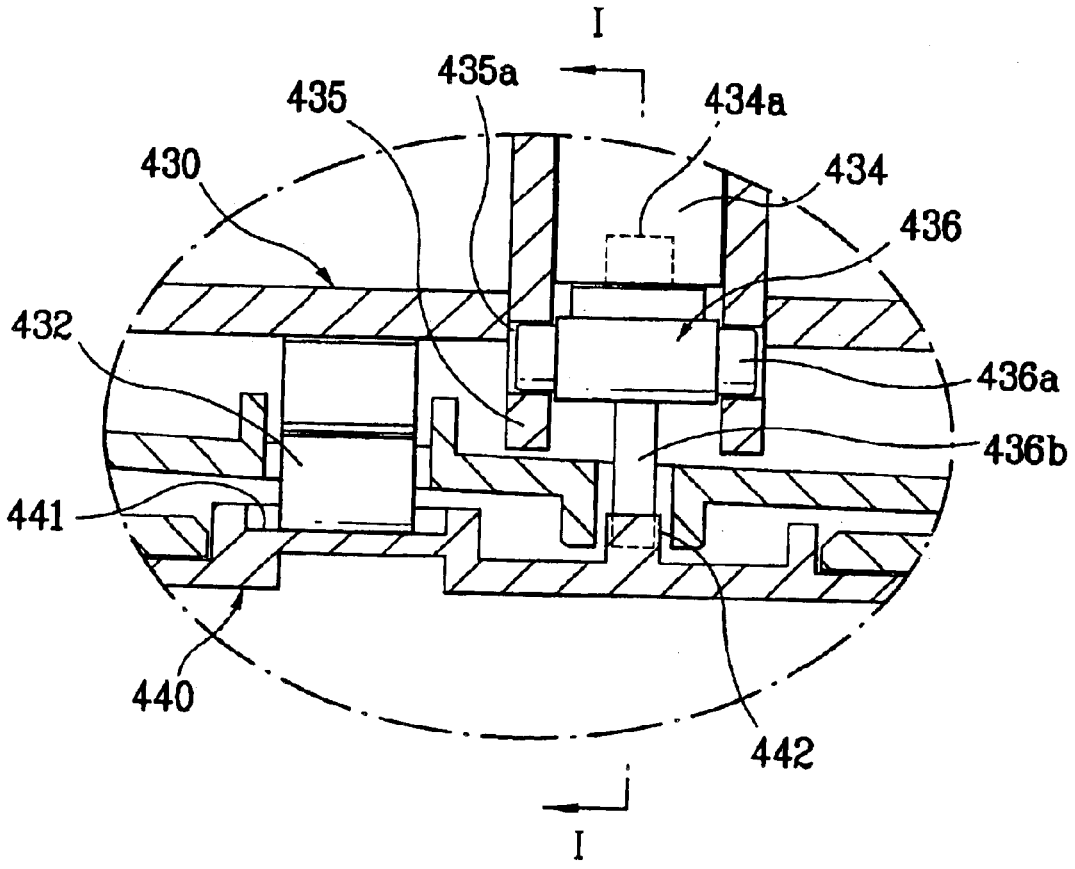
FIG. 4 illustrates a structure of "A" part in FIG. 2 in a state a toaster door is closed to a front panel.
Figure 5:
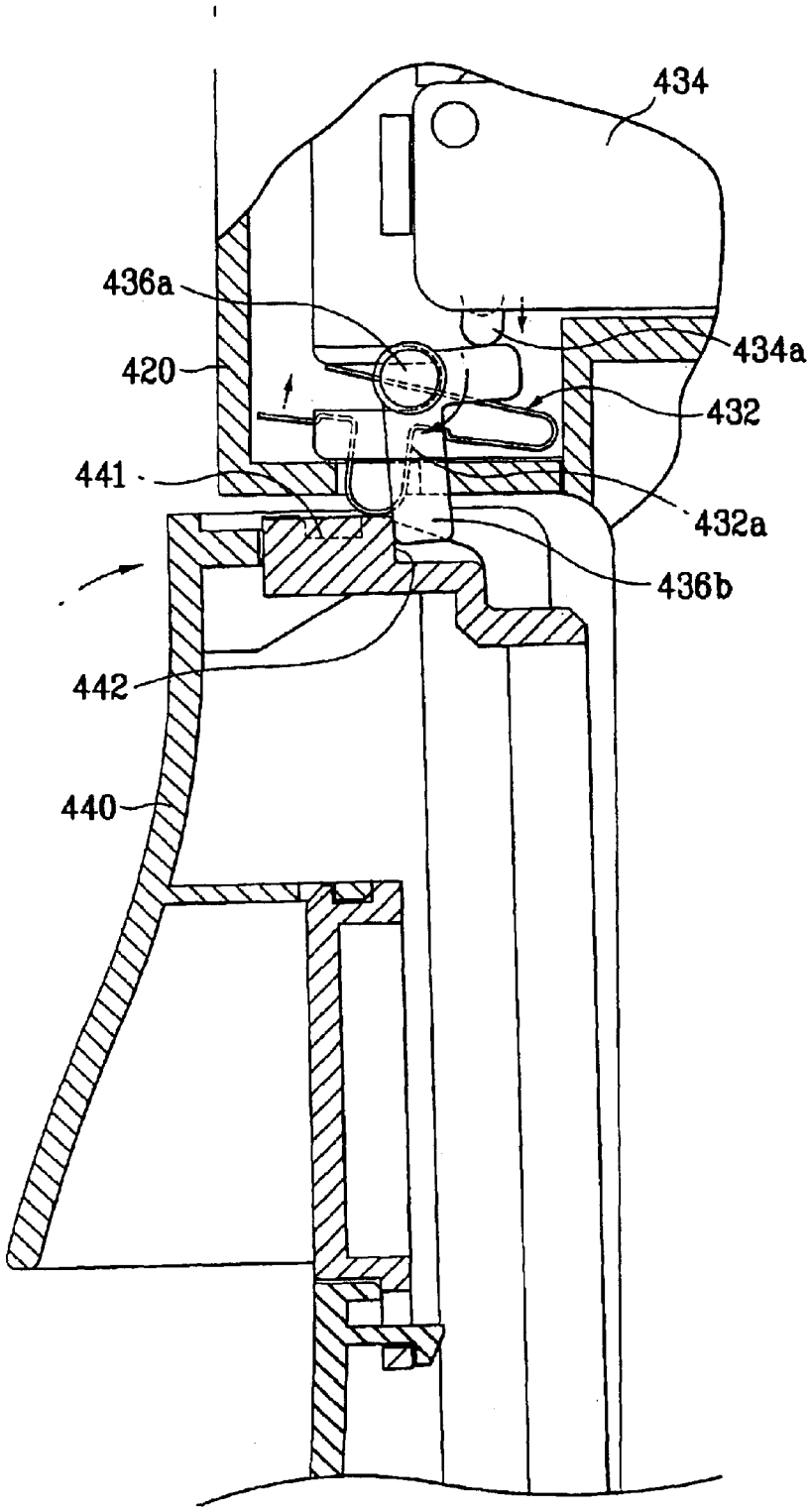
FIG. 5 illustrates a section showing operation of a plate spring and a power cutoff device in a toaster door closing process in a microwave oven with a toaster of the present invention.

Next, a system of the toaster will be described with reference to FIGS. 2 and 3. However, door lock and power source device not shown in FIGS. 2 and 3 will be described in detail with reference to FIGS. 4 and 5 illustrating one of embodiments of the units.

The toaster comprises a toaster case 410, a front plate 420, a front panel 430, a toaster door 440, a door lock (not shown), a power source device (not shown), a heater assembly 450, and a tray assembly 460.

The toaster case 410 has an opened front, and a space therein, and forms an overall outer shape of the toaster. The toaster case 410 also has thin and long slits 411 in opposite sides of a lower part thereof in a front/rear direction. There is a rear plate 413 in rear of the toaster case, and a bread crumb pan 470 drawably mounted under the toaster case.

The front plate 420, mounted to a front surface of the toaster case 410, has at least one introduction opening for bread. That is, a number of pieces of bread capable of toasting at a time is fixed depending on a number of the introduction openings.

The front plate 420, mounted to a front surface of the toaster case 410, forms a frontal outer shape of the toaster, has a rectangular main body with openings in a central part. The front panel also has a heat insulating film for preventing transmission of heat from the heater assembly 450 to the toaster door and the front panel itself.

The toaster door 440 is coupled to the front panel 430 with a hinge so as to open/close the opening in the toaster case 410. The hinge is fitted on a bottom of the toaster door.

The heater assembly 450 is mounted inside of the toaster case 410. The heater assembly 450 comprises a partition wall 452 for dividing an inside space of the toaster case, a hot wire 451 built in the partition wall for generating heat when power is provided thereto, and terminals 453 for providing the power to the hot wire.

A number of spaces formed by the partition wall is the same with a number of pieces of bread to be toasted at a time, which number is the same with the number of the introduction openings in the front plate.

The tray assembly 460 comprises at least one tray 461, a tray supporter 462, one pair of connecting levers 463, and one pair of springs 464.

The tray 461 is used for placing the piece of bread thereon, and pushing and drawing the piece of bread into/out of the toaster case. In more detail, the tray 461 comprises a base 461*a* for placing the piece of bread thereon, and a supporting part 461*b* for supporting a rear side of the piece of bread.

The tray supporter 462 has projections 462*a* at opposite sides for inserting into the slits 411 in the toaster case 410, each having a bushing 466 mounted thereon.

The bushing 466 guides a moving path of the tray supporter 462 in a state exposed to an outside of the slits 411 in the toaster case. It is preferable that the bushing 466 is formed of a heat resistant plastic, such as Teflon and the like.

The spring 464 has one end fixed to the tray supporter 462, and the other end fixed to a rear plate 413 mounted in a rear of the toaster case 410.

In the meantime, the foregoing toaster has a structure for pushing or drawing the piece of bread into/out of the toaster through a front side thereof, the toaster may have a structure for pushing or drawing the piece of bread into/out of the toaster through an upper side thereof.

Next, detailed embodiments of the door lock and the power source device will be described with reference to FIGS. 4, 5, and 6. However, since parts other than the toaster part are the same with the foregoing description, description of which will be omitted.

Figure 6:
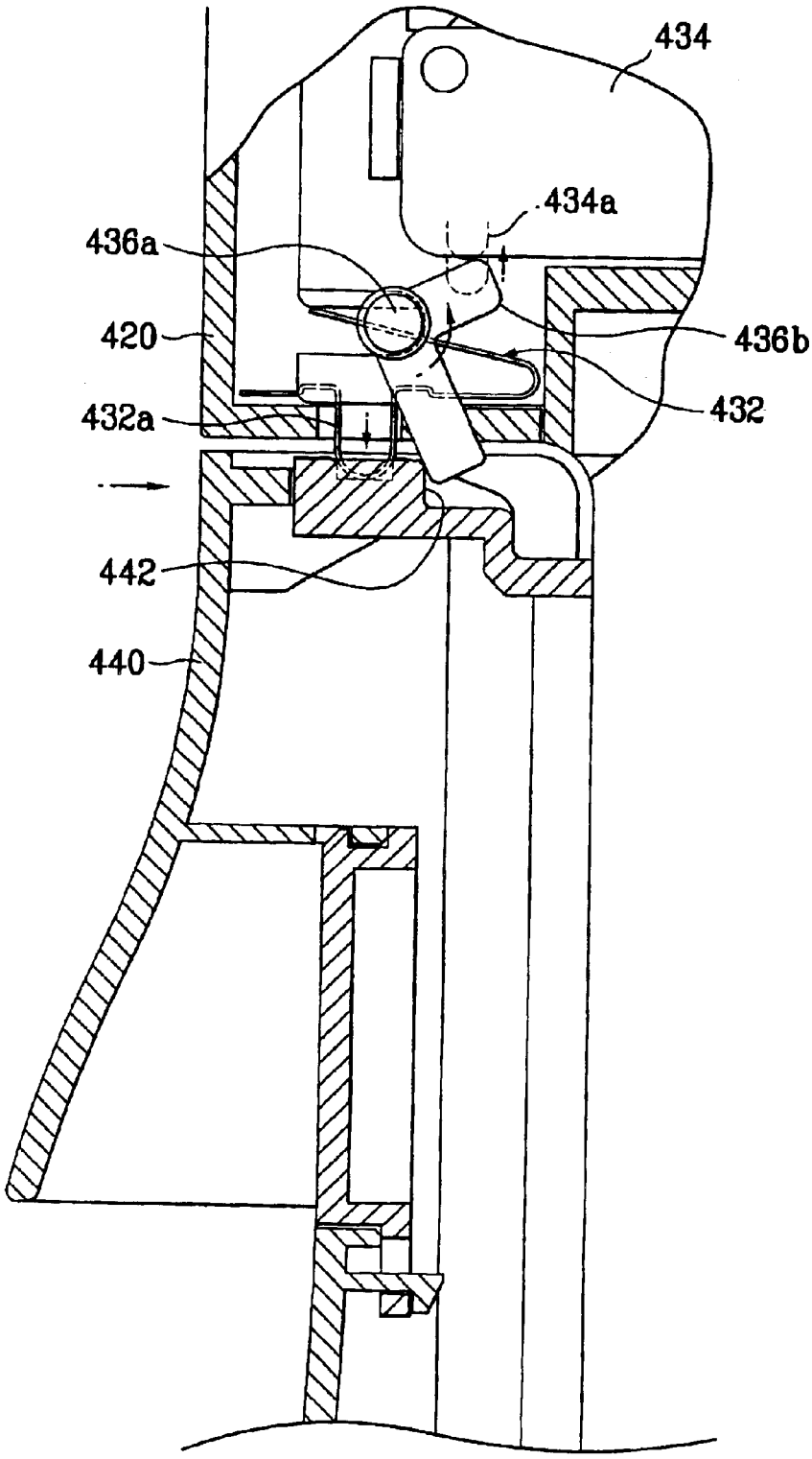
FIG. 6 illustrates a section showing operation of a plate spring and a power cutoff device in state a toaster door is closed completely in a microwave oven with a toaster of the present invention.

FIG. 4 illustrates a structure of "A" part in FIG. 2 in a state the toaster door 440 is closed to a front panel 430, FIG. 5 illustrates a diagram showing the door lock and the power source device in a toaster door closing process, and FIG. 6 illustrates a diagram showing the door lock and the power source device in state a toaster door is closed completely.

Referring to FIG. 4, the door lock and the power source device 434 are mounted on the front panel 430.

In this embodiment, the door lock has a plate spring 432. The plate spring 432 serves to keep a closed state by holding the toaster door when the toaster door is closed for toasting bread.

The power source device 434 provides power to the heater assembly 450 when the toaster door 440 is closed to the front panel 430, and, preferably, only when the toaster door 440 is closed to the front panel 430, fully.

With regard to structures of the plate spring 432 and the power source device 434 in FIG. 4, a part of the plate spring is projected from an upper part of the front panel 432 toward a central opening. The power source device 434, comprising a switch 434*a* projected from a main body of the power source device, is on one side of the plate spring.

In more detail, the plate spring 432 of a channel section has a locking part at one side for holding the toaster door. In more detail, the plate spring 432 has a projection 432*a* projected to outer side on a lower part thereof, for holding the toaster door. The projection of the plate spring is projected toward the central opening through a hole in the front panel.

Of course, the device for holding the toaster door is not limited to the structure of the plate spring, but a variety of structures may be selected. For an example, a button type, or a projection supported on a spring and having a contact part to the toaster door with a moderate curvature may be employed.

The toaster door 440 has a catch recess 441 in a top surface thereof in conformity with the locking part of the plate spring, i.e., the projection 432*a*, and a push pushing projection 442 on one side of the catch recess 441 of the toaster door opposite to the switch 434*a* of the power source device. In this structure, the push projection on the toaster door is brought to push the switch of the power source device in a process the toaster door is closed, thereby providing a power.

More preferably, the toaster additionally comprises a lever 436 for serving as an intermediary between the switch and the projection. The lever 436 serves to transmit a force the pushing projection 442 on the toaster door pushes the switch 434*a* of the power source device.

In more detail, the lever 436 has a body 436*b* of an angle section, and a shaft 436*a* at a bent part of the body as a rotation center of the body.

One side of the bent lever body 436*b* faces the switch 434*a*, and the other side of the bent lever body 436*b* faces the pushing projection 442. The shaft 436*a* of the lever is inserted in supporting holes 435*a* in opposite sides under the switch.

According to the foregoing structure, when the user closes the toaster door 440, the projection 432*a* of the plate spring is pushed, and moved up by the toaster door, and holds the catch recess with a restoring force when the projection 432*a* comes to the catch recess 441 in the toaster door, thereby locking the toaster door 440.

At the same time with this process, the pushing projection 442 on the toaster door applies a force to one side of the lever body 436*b*, to rotate the lever, which makes the other side of the lever body to press the switch 434*a* of the power source device, to provide power.

More preferably, it is designed that the switch supplies power of the power source device only in a state the toaster door is closed perfectly. In other words, a mechanism is required, in which the switch is not pressed adequately in a state the toaster door is not closed perfectly.

An operation of the foregoing toaster of the microwave oven will be described in detail with reference to FIGS. 5 and 6.

If it is intended to toast bread, the toaster door 440 is opened to open a front surface of the toaster case 410. In this instance, the connection levers 463 connected to opposite sides of the toaster door 440 are moved, to move the tray supporter 462 connected to the other ends of the connection levers to forward of the toaster case.

In other words, the bushings 466 on the tray supporter 462 move forward guided by the slits 411 in opposite sides of the toaster case, and the trays 461 connected to an upper surface of the tray supporter 462 also move forward, until parts of the trays 461 are exposed through a front surface of opened toaster case 410.

Next, when the user places pieces of bread on the exposed trays 461, and closes the toaster door 440, the tray supporter 462 moves to an inside of the toaster case by a restoring force of the spring connected to the lever, so that the pieces of bread are moved into an inside of the toaster case 410 and seated at a cooking position.

A process the toaster door is closed, and power is supplied to the power source device in the foregoing process is as follows.

After the toaster door is started to close, when the toaster door comes into contact with the projection 432*a* of the plate spring, the plate spring 432 moves up by a pushing force of the toaster door 440, which state is illustrated in FIG. 5.

Next, when the toaster door is closed completely, the projection 432*a* of the plate spring is seated in the catch recess 441*a* of the door 440 by the restoring force of the plate spring, and holds the toaster door not to open.

At the same time with the process, the pushing projection 442 of the toaster door applies a force to one side of the lever body 436*b*, such that the other side of the lever body presses the switch 434*a* to provide a power to the power source device, to generate heat at the hot wire 451 built in the heater assembly, and toast the bread.

In this process, as described before, if the toaster door 440 is not closed completely due to carelessness of the user, the switch 434*a* is not pressed, to fail supply of the power. Therefore, as one of different embodiments of the present invention, a system in which the toaster is operative only in a state the toaster door is closed completely is suggested.

As has been described, the microwave oven with a toaster of the present invention has the following advantages.

By adding a toasting function to a related art microwave oven function of cooking food, the inconvenience of providing separate toaster is eliminated, and a frequency of use of the microwave oven is increased.

Next, since power is supplied to the toaster automatically when the toaster door is closed, particularly only when the toaster door is closed completely, the microwave oven of the present invention can prevent waste of power caused by user's carelessness, and prevents accidents caused by negligence of safety.

The heat insulating film on the front panel of the microwave oven prevents heat from being transmitted to the toaster door and the front panel, to prevent thermal deformation of the microwave oven.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A microwave oven with a toaster comprising:

a main case forming an outer shape;

a cavity in the main case for cooking food therein with a microwave;

an electronic chamber in one side part of the main case having different electronic components for providing the microwave to an inside of the cavity, and a toaster comprising, a toaster case in front of the electronic chamber having slits in opposite sides respectively, a tray assembly mounted on the slits of the toaster case for introducing/taking out pieces of bread into/out of the toaster, a heater assembly in the toaster case for heating the pieces of bread, a toaster door on the toaster case, a door lock for holding the door, and a power source device for supplying power to the heater assembly wherein the door lock is operatively associated with the power source.

2. The microwave oven as claimed in claim 1, wherein the toaster further comprises;

a front plate mounted to a front of the toaster case, the front plate having openings for introducing pieces of bread therethrough, and a front panel having a rectangular body with a central opening mounted to a front of the front plate to form an outer shape of the toaster, and the toaster door coupled thereto.

3. The microwave oven as claimed in claim 2, wherein the door lock for holding the door comprises a plate spring mounted on the front panel for holding the toaster door to keep a closed state once the toaster door is closed.

4. The microwave oven as claimed in claim 3, wherein the plate spring has a channel section, and comprises a locking part at a lower side thereof for holding the toaster door.

5. The microwave oven as claimed in claim 4, wherein the locking part comprises a projection of a lower part of the plate spring toward the opening in the front panel, and the toaster door comprises a catch recess in conformity with the projection of the plate spring.

6. The microwave oven as claimed in claim 2, wherein the power source device comprises a switch to be pressed when the toaster door is closed.

7. The microwave oven as claimed in claim 6, wherein the toaster further comprises lever at the front panel having one side opposite to the power source device and the other side opposite to the toaster door, for transmitting a pushing force of the toaster door to the switch.

8. The microwave oven as claimed in claim 7, wherein the lever comprises a part opposite to the toaster door projected to the opening side.

9. The microwave oven as claimed in claim 8, wherein the toaster door further comprises a push projection opposite to the projection on the lever.

10. The microwave oven as claimed in claim 9, wherein the lever rotates and pushes the switch of the power source device as the pushing projection of the toaster door pushes the lever when the toaster door is closed.

11. The microwave oven as claimed in claim 10, wherein the lever comprises;

a body of an angle section, and a shaft at a bent part for rotatably mounting the body.

12. The microwave oven as claimed in claim 10, wherein the switch is pushed with the lever fully, to supply power to the heater assembly, only when the toaster door is closed completely.

13. The microwave oven as claimed in claim 11, wherein the switch is pushed with the lever fully, to supply power to the heater assembly, only when the toaster door is closed completely.

14. The microwave oven as claimed in claim 2, wherein the front panel further comprises a heat insulating film for preventing transmission of heat from the heat assembly to the toaster door and the front panel itself.

15. A microwave oven with a toaster comprising:

a main case forming an outer shape;

a cavity in the main case for cooking food therein with a microwave;

an electronic chamber in one side part of the main case having different electronic components for providing the microwave to an inside of the cavity, and a toaster comprising;

a toaster case in front of the electronic chamber having slits in opposite sides respectively, a tray assembly mounted on the slits of the toaster case for introducing/taking out pieces of bread into/out of the toaster, a heater assembly in the toaster case for heating the pieces of bread, a toaster door on the toaster case having a catch recess, a plate spring of a channel section having a projection from a lower part for being held at the catch recess in the toaster door, a rectangular front panel on a front surface of the toaster case to form a frontal outer shape thereof having a central opening for mounting the toaster door, a power source device for supplying power to the heater assembly, and a lever mounted on the opening side of the front panel having one side facing the power source device and the other side projected to the opening for being pushed with the toaster door.

16. The microwave oven as claimed in claim 15, wherein the power source device comprises a switch facing one side of the lever.

17. The microwave oven as claimed in claim 16, wherein the toaster door further comprises a pushing projection facing the projection from the lever.

18. The microwave oven as claimed in claim 17, wherein the lever rotates and pushes the switch of the power source device as the pushing projection of the toaster door pushes the lever when the toaster door is closed.

19. The microwave oven as claimed in claim 18, wherein the lever comprises;

a body of an angle section, and a shaft at a bent part for rotatably mounting the body.

20. The microwave oven as claimed in claim 19, wherein the switch is pushed with the lever fully, to supply power to the heater assembly, only when the toaster door is closed completely.

* * * * *